US007662260B2

(12) United States Patent
Thoroe-Scherb et al.

(10) Patent No.: US 7,662,260 B2
(45) Date of Patent: Feb. 16, 2010

(54) METHOD FOR THE MANUFACTURE OF A FIBER WEB PROVIDED WITH A THREE-DIMENSIONAL SURFACE STRUCTURE

(75) Inventors: Thomas Thoroe-Scherb, Sao Paulo (BR); Harald Schmidt-Hebbel, Barucri (BR); Jeffrey Herman, Bala Cynwyd, PA (US)

(73) Assignee: Voith Patent GmbH, Heidenheim (DE)

( * ) Notice: Subject to any disclaimer, the term of this patent is extended or adjusted under 35 U.S.C. 154(b) by 182 days.

(21) Appl. No.: 11/845,828

(22) Filed: Aug. 28, 2007

(65) Prior Publication Data

US 2007/0289159 A1 Dec. 20, 2007

Related U.S. Application Data

(60) Division of application No. 10/739,470, filed on Dec. 18, 2003, now Pat. No. 7,291,249, which is a continuation of application No. PCT/EP02/05808, filed on May 27, 2002.

(30) Foreign Application Priority Data

Jun. 20, 2001 (DE) ..... 101 29 613

(51) Int. Cl.
*D21F 11/00* (2006.01)
*F26B 3/06* (2006.01)

(52) U.S. Cl. ..... 162/205; 162/206; 162/207; 34/444; 34/399

(58) Field of Classification Search ..... 162/109, 162/111–113, 115, 117, 204–206, 900–904; 34/397–400, 94, 143, 618, 545, 459, 114–116, 34/443–444

See application file for complete search history.

(56) References Cited

U.S. PATENT DOCUMENTS

| | | | | |
|---|---|---|---|---|
| 3,301,746 | A * | 1/1967 | Sisson et al. | 162/113 |
| 4,102,737 | A * | 7/1978 | Morton | 162/113 |
| 5,795,440 | A * | 8/1998 | Ampulski et al. | 162/117 |
| 5,846,380 | A * | 12/1998 | Van Phan et al. | 162/111 |
| 6,051,105 | A * | 4/2000 | Ampulski | 162/117 |
| 6,103,062 | A * | 8/2000 | Ampulski et al. | 162/109 |
| 6,190,506 | B1 * | 2/2001 | Beck | 162/357 |
| 6,616,812 | B2 * | 9/2003 | Beck | 162/358.2 |
| 6,780,282 | B2 * | 8/2004 | Scherb et al. | 162/111 |
| 6,986,830 | B2 * | 1/2006 | Scherb et al. | 162/202 |
| 7,150,110 | B2 * | 12/2006 | Herman et al. | 34/399 |
| 7,291,249 | B2 * | 11/2007 | Thoroe-Scherb et al. | 162/358.1 |
| 7,323,087 | B2 * | 1/2008 | Beck | 162/205 |
| 7,351,307 | B2 * | 4/2008 | Scherb et al. | 162/115 |

(Continued)

FOREIGN PATENT DOCUMENTS

DE 10129613 A1 * 1/2003

(Continued)

*Primary Examiner*—José A Fortuna
(74) *Attorney, Agent, or Firm*—Taylor & Aust, P.C.

(57) ABSTRACT

A method for the manufacture of a structured fiber web including the steps of pressing a fiber web onto an imprinting fabric by way of a first pressure field, thereby pre-imprinting the fiber web, the fiber web having a dry content of less than approximately 35%, and subsequently pressing the fiber web onto the imprinting fabric by way of a further pressure field.

74 Claims, 4 Drawing Sheets

U.S. PATENT DOCUMENTS

| | | | | |
|---|---|---|---|---|
| 7,428,786 | B2 * | 9/2008 | Herman et al. | 34/399 |
| 2002/0060046 | A1 * | 5/2002 | Scherb et al. | 162/358.1 |
| 2003/0056925 | A1 * | 3/2003 | Beck | 162/358.1 |
| 2003/0136018 | A1 * | 7/2003 | Herman et al. | 34/114 |
| 2004/0180596 | A1 * | 9/2004 | Beck | 442/326 |
| 2004/0237210 | A1 * | 12/2004 | Thoroe-Scherb et al. | 8/115.51 |
| 2004/0244933 | A1 * | 12/2004 | Scherb et al. | 162/359.1 |
| 2005/0126031 | A1 * | 6/2005 | Herman et al. | 34/114 |
| 2005/0167062 | A1 * | 8/2005 | Herman et al. | 162/115 |
| 2006/0225300 | A1 * | 10/2006 | Herman et al. | 34/114 |
| 2007/0289159 | A1 * | 12/2007 | Thoroe-Scherb et al. | 34/306 |

FOREIGN PATENT DOCUMENTS

| | | | |
|---|---|---|---|
| EP | 926296 | A2 * | 6/1999 |
| EP | 1626121 | A1 * | 2/2006 |
| JP | 2008190114 | A * | 8/2008 |
| WO | WO 9300475 | A1 * | 1/1993 |
| WO | WO 03000002 | A1 * | 1/2003 |

* cited by examiner

METHOD FOR THE MANUFACTURE OF A FIBER WEB PROVIDED WITH A THREE-DIMENSIONAL SURFACE STRUCTURE

CROSS REFERENCE TO RELATED APPLICATIONS

This is a divisional of U.S. patent application Ser. No. 10/739,470; now U.S. Pat. No. 7,291,249, entitled "METHOD AND AN APPARATUS FOR THE MANUFACTURE OF A FIBER WEB PROVIDED WITH A THREE-DIMENSIONAL SURFACE STRUCTURE," filed Dec. 18, 2003, which is a continuation of PCT Application No. PCT/EP02/05808, entitled "METHOD AND DEVICE FOR PRODUCING A FIBRE STRIP PROVIDED WITH A THREE-DIMENSIONAL SURFACE STRUCTURE", filed May 27, 2002.

BACKGROUND OF THE INVENTION

1. Field of the Invention

The present invention relates to a method and to an apparatus for the manufacture of a fiber web, and, more particularly, to a method and an apparatus for the manufacture of a tissue web or a hygienic paper web, provided with a three-dimensional paper structure.

2. Description of the Related Art

The imprinting of a three-dimensional structure into the surface of a paper web, in particular of a tissue web or of a hand tissue, is known, see, for example, WO 99/47749 and WO 01/18307. It is further known that a very good paper quality can be achieved by a so-called throughflow air drying (TAD=through air drying). It is, however, disadvantageous that the use of TAD dryers is very complex and correspondingly expensive.

What is needed in the art is a simple, more economical way of providing a high quality structural tissue.

SUMMARY OF THE INVENTION

The present invention provides an improved method and an improved apparatus to form a high quality structured tissue in an economic and correspondingly cost-favorable manner, without the use of a larger TAD drying apparatus. The expected quality level is achieved with respect to the water retention capability, the water absorption speed and the volume (bulk), etc.

In accordance with one embodiment the present invention, a method is disclosed for the manufacture of a fiber web, specifically a tissue web or a hygienic paper web, with a three-dimensional surface structure. The fiber web is pressed, for example by vacuum drawing it, onto an imprinting fabric at a dry content <35% by way of a first pressure field. The web is thereby pre-imprinted and is then subsequently pressed onto an imprinting fabric a further time by way of a further pressure field for the further dewatering and drying of the web in order to fix the three-dimensional surface structure and the strength.

A sustainable three-dimensional surface structure is produced in the relevant fiber web, which remains present in the desired manner in the web, after the drying process. The use of a complex and correspondingly expensive TAD method is no longer required. In particular, a sustainable surface structure of, for example, a tissue web or a hygienic paper web can now be produced after the forming region, or forming zone, even without a TAD drying device.

An imprinting screen or an imprinting membrane is used as the imprinting band or structured band also, respectively known as "imprinting fabric" and "structured fabric". The fiber web is generally pre-imprinted after the forming zone.

It is often an advantage for the fiber web to be formed on the imprinting fabric that is used for the pre-imprinting. The fiber web can also be transferred to the imprinting fabric used for the preimprinting.

Another embodiment of the method of the present invention is characterized in that at least three throughflow apparatuses are utilized and they are arranged in series in the web running direction. In the region of each throughflow apparatus the fiber web is exposed to a respective throughflow, in particular to an air throughflow, with the throughflow directions, as they relate to the fiber web, being at least partly different or opposite to one another in the different throughflow apparatuses. In particular at least three throughflow apparatuses are used in which the throughflow direction of at least one throughflow apparatus differs, with respect to the web, from the throughflow direction of the other throughflow apparatuses, which may be located on an upper side or lower side of the web.

In this embodiment each throughflow apparatus includes a suction device. Alternatively, at least one of the throughflow apparatuses may include a suction device and at least one of the throughflow apparatuses may include an air press. For example, in the web running direction, a first throughflow apparatus can include a suction device, a second throughflow apparatus can include an air press and a third throughflow apparatus can again include a suction device.

A respective suction device can in particular include a suction roll, a suction box and/or the like in each case.

Advantageously, at least one suction device is used in which the pressure difference ($\Delta p$) lies in a range of from approximately 0.2 up to approximately 0.4 bar. The temperature is preferably <220° C., in particular ≦180° C. and preferably ≦150° C. The airflow speed through the fiber web is preferably less than ≦15 m/s, particularly with very fine clothings. The result is a much lower energy requirement and a much lower complexity of the technical plant than with the conventional TAD process. The dwell time of the fiber web in the suction zone is advantageously ≦0.5 s, in particular ≦0.4 s and preferably ≦0.3 s.

In accordance with another embodiment of the present invention, at least the first pressure field is produced by way of a suction element arranged on the side of the imprinting fabric remote from the fiber web in order to suck the fiber web into the surface structure of the imprinting fabric. In particular a so-called wet suction box can be used as the suction element.

It is also of advantage for the fiber web to be further pressed gently in the pressure field, preferably over a path extending in the web running direction.

The further pressure field is produced by way of a press nip. To effect a pressing of the web, which is as gentle as possible, this press nip can be produced, for example, between a drying cylinder and a counter element. The fiber web is guided through the press nip and is in contact with the surface of the drying cylinder on one side and the other side is in contact with the imprinting fabric. In particular, a so-called Yankee cylinder can be used as the drying cylinder. A shoe press unit, which includes a flexible fabric guided over a shoe press in the region of the press nip, can be used as a counter element cooperating with the drying cylinder. A shoe press roll, provided with a flexible roll jacket, is preferably used as the shoe press unit in this process.

Advantageously, a soft fabric or a clothing with fine pores and a capillary effect (capillary fabric), in particular felt, is provided inside the loop of the imprinting fabric to guide the web through the press nip, thereby producing the further pressure field. The soft felt can, for example, be a felt with a foamed layer, which as will be explained in more detail below, contributes to the dewatering of the fiber web, due to its capillary effect.

Another practical embodiment of the method of the present invention is characterized in that the pre-imprinted fiber web is dried on a drying or a Yankee cylinder, the fiber web is subsequently creped and/or wound up.

In accordance with one of the embodiments of the method in accordance with the present invention, the dry content at which the fiber web is pre-imprinted, and/or the dry content at which the three-dimensional surface structure is fixed, is selected to be <35%, preferably <30% and more preferably <25%. In this process the water retention capability and the bulk is thus sustainably increased, which means that the desired imprint is still present even on the use of the end product, such as the tissue or hygienic paper web. In particular, the advantage of a higher water retention capability for a hand towel tissue or a paper towel is apparent in the use of the respective end product.

In accordance with one of the embodiments of the method in accordance with the present invention, a device subject to suction is used between the suction element that produces the first pressure field and the press nip that produces the further pressure field. The fiber web is guided, together with an imprinting fabric, over both the device subject to suction and through the press nip. It is advantageous for the device subject to suction, to have a curved surface, and for the fiber web and the imprinting fabric to be guided over this curved surface. A suction roll can, for example, be used as the device subject to suction.

A felt is expediently guided through the press nip between the imprinting fabric and the flexible fabric of the shoe press unit.

In specific cases, it is advantageous for the felt, which is particularly soft, to be guided over the device subject to suction. The suction effect of the device subject to suction is correspondingly reduced in this process, a hood standing under overpressure is associated with it in order to support the underpressure effect of the device subject to suction.

Further advantages result from the relatively long common guidance of the felt and of the imprinting fabric, since the capillary effect of the felt is utilized for the dewatering of the fiber web over the longer path.

The felt can, for example, be conditioned by way of a suction device, in particular by a suction box, before it is joined with the imprinting fabric to support the fiber web. In particular the dry content of the felt can be increased and the felt can be cleaned by appropriate conditioning.

The imprinting fabric is guided over the suction element, or over the wet suction box, prior to the device subject to suction, i.e. prior to the suction roll, in order to suck the fiber web into the three-dimensional surface structure of the imprinting fabric and thus to imprint this structure onto the fiber web. At the same time, the respective suction element brings about a corresponding increase in dry content.

In accordance with another embodiment of the method in accordance with the present invention, the felt is joined with the imprinting fabric supporting the fiber web, after the web passes the device subject to suction. The device subject to suction therefore does not have the felt wrapped around it, whereby the suction effect of this device is increased and the dry content is increased accordingly. The wet imprinting effect (wet molding effect) is maintained by the gentle dewatering of the so-called TissueFlex process, which, in contrast to a shoe press roll, works at a lower pressure and with a longer dwell time.

It is also advantageous for the length of the press nip of the shoe press that includes the drying cylinder and the shoe press unit, in the web running direction, to be larger than a value of approximately 80 mm. Additionally, the shoe press is designed such that a pressure profile results over the press nip length having a maximum pressing pressure, which is lower than or equal to a value of approximately 2.5 MPa. A gentle pressing is thus ensured, which avoids a smoothing out of the structure produced in the fiber web. As previously discussed, a suction roll, with which a pressure hood is associated, can be used between the suction element producing the first pressure field and the press nip.

In accordance with another embodiment of the method in accordance with the present invention, at least one dewatering screen with zonally different screen permeability is used in the forming zone. The respective dewatering screen can be provided as an external screen. This is in particular an advantage in the manufacture of hand towel tissue. The screen produces a fine structure, which increases the water absorption speed and which brings about an increased water retention capability in conjunction with the imprinting.

It is an advantage for a former to have two peripheral dewatering fabrics, which run together while forming a material inlet gap and are guided over a forming element such as a forming roll and for a dewatering screen, with zonally different screen permeability. The dewatering fabrics can be used as an external fabric that does not come into contact with the forming element and as an internal fabric. An imprinting fabric can be used as the internal fabric and a dewatering screen with zonally different screen permeability can be used as the external fabric in this process. It is, for example, also possible for the fiber web to be passed from the internal fabric to an imprinting fabric.

During wet molding in a tissue machine, that utilizes an imprinting fabric, it is a particular goal to achieve a desired dry content. The web can be wet molded by way of the imprinting fabric, for example, by way of a suction box prior to the press. To avoid disrupting the three-dimensional structure, which was pre-imprinted by the wet molding in the region of the wet suction box, by a shortterm high pressure in the press nip, an imprinting fabric, such as, an imprinting screen or an imprinting membrane, is guided through the press nip. The imprinting fabric is structured such that a surface portion has raised or closed zones, which are small in comparison with the surface portion of recessed zones or bores of the web and, accordingly, a smaller surface portion of the fiber web is pressed in the press nip. The smaller surface portion of raised or closed zones results in web zones of high density for strength. The larger surface portion of recessed zones or bores remains at least substantially unpressed, and results in the desired water absorbing capability and the desired bulk, such as was previously only achieved by the complex and expensive TAD drying.

An imprinting fabric can advantageously be used in which the surface portion of raised or closed zones are ≦40% of the surface area and preferably lies in a range from approximately 25% to approximately 30%. The imprinting fabric may have raised zones and recessed zones that result from offsets, such as, by intersection points of weft and warp threads, of a screen fabric. As already mentioned, an imprinting membrane can also be used, in which the raised and recessed zones result from bores therein. In this case, it is of advantageous that 100% of the surface except for the bore area is pressed and a higher strength results.

The respective imprinting fabric is guided together with the fiber web over, for example, a drying cylinder, in particular over a Yankee cylinder. A shoe press unit is used as the counter element cooperating with the drying cylinder. The length of the press nip and the pressure profile resulting over the press nip length can be selected as has previously been recited.

It has been shown that a water absorption capability (g $H_20$/g fibers) is higher by 50% and bulk ($cm^3$/g) is higher by 100% as a result of using the method in accordance with the invention, at the same tensile strength, when an imprinting fabric is used instead of a conventional felt in the press nip prior to the creping. By creping the web, the water absorption capability can be improved by 50% and a water absorption capability of TAD hand towel quality can be achieved.

The improved quality of the paper results as a consequence of the lower pressure pressing of the web as a consequence of the smaller surface portion of raised zones and not by a TAD drier. The permeability of the web results by the stretching of the web into the fabric structure by way of the suction element, whereby so-called pillows are produced, which increase the water absorption capability and the bulk accordingly. A relatively complex and correspondingly expensive TAD drier is therefore no longer required for this purpose.

The function of the TAD drum and of the air throughflow system consists of drying the web. The appropriate dry content must be achieved in order to be able to carry out the wet molding in a conventional machine, i.e. in particular in a conventional tissue machine.

In contrast to the TAD system, in order to reduce the rewetting and to keep the desired dry content, in accordance with a preferred embodiment of the method of the present invention, at least one clothing with fine pores and with a capillary effect is used for the dewatering of the web and this can be e.g. a felt or a screen with a foamed layer. The foam coating is chosen such that pores result in a range from approximately 3 μm up to approximately 6 μm. The corresponding capillary effect is utilized for the dewatering. The respective clothing, such as a felt, can be provided with a special foam layer, which gives the surface very small pores whose diameter lie in the range of from approximately 3 μm up to approximately 6 μm. The air permeability of this clothing is very low. The natural capillary effect is utilized for the dewatering of the web while it is in contact with the clothing.

A clothing with fine pores, such as a screen or a felt with a foamed layer, is guided together with an imprinting fabric and a fiber web lying therebetween about a suction roll, with the clothing with fine pores preferably being in contact with the suction roll. The clothing with fine pores can, wrap around a suction roll with a diameter from approximately 2 to 3 m, or around a plurality of suction rolls with smaller diameters, preferably around suction rolls with a diameter in each case of, approximately 2 m. The dwell time of the web in the region of the suction rolls or should be longer than approximately 0.15 sec. and shorter than approximately 0.40 sec.

The respective suction roll can be acted on by a vacuum on its lower side or a suction roll with associated siphon extraction can be used. The water can also be centrifuged into a gutter by centrifugal force, in particular with a lower diameter roll.

Dewatering utilizing the capillary effect is described in U.S. Pat. No. 5,701,682. The respective capillary element is, however, part of the suction roll in the present invention. The use of a clothing with fine pores and with a capillary effect results in the following advantages in comparison with a roll:

better cleaning
easier replacement
cheaper
simpler water removal from the roll since the roll jacket is more open than a foamed jacket.

Despite the utilization of the capillary effect for dewatering, a hood standing under overpressure can be associated with the device subject to suction in order to support the underpressure effect of the device subject to suction.

In accordance with a further embodiment of the method in accordance with the present invention, the fiber web is guided, together with an imprinting fabric for the expulsion of water by means of gas pressure, at least once, preferably twice, through a pressure space. The pressure space is bounded by at least four rolls arranged in parallel and into which a gas under pressure is introduced. The fiber web is guided through the pressure space together with the imprinting fabric and a membrane. The basic principle of such a displacement press, in which the water in the fiber web is displaced by air, is described in German Patent DE 199 46 972.

In accordance with another embodiment of the method in accordance with the present invention, a vacuum dewatering of the fiber web takes place in which the pressure difference ($\Delta p$) is $\geqq 0.1$ bar, preferably $\geqq 0.2$ bar and more preferably $\geqq 0.3$ bar. The pressure difference ($\Delta p$) can in particular lie in a range from approximately 0.2 bar up to approximately 0.4 bar. In contrast to the conventional TAD method, an open surface of approximately 20% is advantageously provided. A clothing with fine pores, such as a screen or a felt with a foamed layer, is used for the vacuum dewatering. The open surface in this process is, however, preferably very small such that a very small air volume flow results.

In accordance with still another embodiment of the method in accordance with the present invention, the vacuum dewatering takes place such that an air volume flow $\leqq 50$ $m^3/m^2 \cdot min$, in particular $\leqq 20$ $m^3/m^2 \cdot min$, in particular $\leqq 5$ $m^3/m^2 \cdot min$ and preferably $\leqq 1$ $m^3/m^2 \cdot min$ (to practically zero $m^3/m^2 \cdot min$) results.

A corresponding "Spectra" membrane, which can be used for vacuum dewatering, allowing an airflow of 15 m/s so a higher vacuum is needed.

The apparatus in accordance with another embodiment of the present invention for the manufacture of a fiber web, in particular a tissue web or a hygienic paper web, provided with a three-dimensional surface structure is accordingly characterized in that the fiber web is pressed e.g. by suction onto an imprinting fabric at a dry content <35% by way of a first pressure field. The web being thereby pre-imprinted and subsequently pressed onto an imprinting fabric a further time by way of a further pressure field for further dewatering and drying in order to fix the three-dimensional surface structure and the strength thereof.

The invention can in particular be used with Crescent Formers, Duo Formers, C Wrap Formers, S Wrap Formers and in the manufacture of multi-layer and multi-ply tissue.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
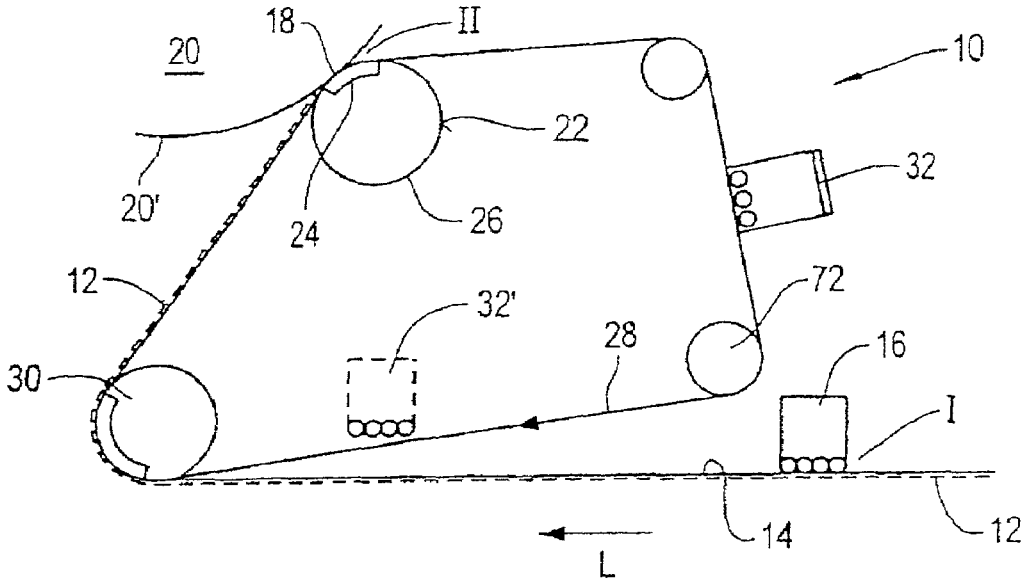
FIG. 1 is a schematic partial representation of an embodiment of an apparatus for the manufacture of a fiber web provided with a three-dimensional surface structure.

Referring now to the drawings, and more particularly to FIG. 1 there is shown a schematic partial representation of an apparatus 10 for the manufacture of a fiber web 12 provided with a three-dimensional surface structure, which can in particular be a paper web and preferably a tissue web or a hygienic paper web.

Fiber web 12 is pressed, e.g. sucked, onto an imprinting fabric 14, also known as a structured fabric 14, at a dry content <35% by way of a first pressure field I and is thereby pre-imprinted. Fabric web 12 is subsequently pressed once again onto imprinting fabric 14 by way of a further pressure field II, for the further dewatering and drying of web 12 in order to fix the three-dimensional surface structure and the strength. In particular, an imprinting screen can be provided as imprinting fabric 14.

In one embodiment of the present invention, imprinting fabric 14 is provided for the imprinting and for the fixing of the surface structure.

First pressure field I is produced by way of a suction element 16 arranged on the side of imprinting fabric 14 remote from fiber web 12. Fiber web 12 is sucked into the surface structure of imprinting fabric 14. Suction element 16 can in particular be embodied as a suction box 16 or as a wet suction box 16.

In further pressure field II, fiber web 12 is pressed, preferably gently, and in particular, over a path extending in a web running direction L. Further pressure field II is produced by way of a press nip 18, which is formed between a drying cylinder 20 and a counter element 22. Fiber web 12 is guided through press nip 18 and is in contact with surface 20' of drying cylinder 20. Web 12 contacts imprinting fabric 14 on its other side.

Specifically, a Yankee cylinder can be provided as drying cylinder 20.

A shoe press unit 22, which includes a flexible fabric 26 guided over a press shoe 24, in the region of press nip 18, can preferably be provided as a counter element 22 cooperating with drying cylinder 20. A shoe press roll with a flexible roll jacket 26 is provided as shoe press unit 22. Press nip 18 extends in web running direction L, whereby a relatively gentle pressing of fiber web 12 is achieved.

A fabric 28, preferably a soft fabric, or a clothing with fine pores and with a capillary effect (capillary fabric), in particular a soft felt or a soft foamed felt, can be guided through press nip 18, inside the loop of imprinting fabric 14. This soft fabric 28 or clothing 28 with fine pores runs between imprinting fabric 14 and flexible fabric 26 of shoe press unit 22.

Fiber web 12 can be dried on drying cylinder 20, such as, for example, on a Yankee cylinder. Fiber web 12 can moreover be creped. Web 12 can be wound up by an appropriate device.

The dry content at which fiber web 12 is pre-imprinted and/or the dry content at which the three-dimensional surface structure is fixed is, as already mentioned, <35% and preferably be <30 and more preferably <25.

A device subject to suction 30, which can in particular be a suction roll 30, is provided between suction element 16 and press nip 18. Fiber web 12 is guided together with imprinting fabric 14 both over the device subject to suction 30 and through press nip 18. Clothing 28 with fine pores such as felt 28, is guided through press nip 18 between imprinting fabric 14 and flexible fabric 26 of shoe press unit 22.

Felt 28 is not only guided through press nip 18, but also over the device subject to suction 30. Since the suction effect of device 30 is reduced by the resistance of felt 28, a hood standing under overpressure is associated with the device subject to suction 30 to support the underpressure effect of the device subject to suction 30.

A suction device 32 such as a suction box 32, or the like, is provided for the conditioning of felt 28. As can be recognized with reference to FIG. 1, suction device 32 conditions felt 28 and is arranged in front of the device subject to suction 30 in whose region felt 28 is joined with imprinting fabric 14 that is supporting fiber web 12. Suction device 32 is arranged in front of lower deflection roll 72. However, generally an arrangement after lower deflection roll 72 is also possible as shown in the broken-line representation 32'.

Water is removed from fiber web 12 over a longer path by the capillary effect of felt 28 due to the relatively long common guidance of felt 28 and of imprinting fabric 14. Felt 28 is conditioned beforehand via suction device 32, whereby its dry content is increased and felt 28 is cleaned.

Imprinting fabric 14 is guided over suction element 16 in front of the device subject to suction 30, which in addition to an increase in dry content brings about a pre-imprinting of fiber web 12. Fiber web 12 is sucked into the three-dimensional surface structure of imprinting fabric 14 or of imprinting screen 14, whereby the structure is imprinted onto the web.

Figure 2:
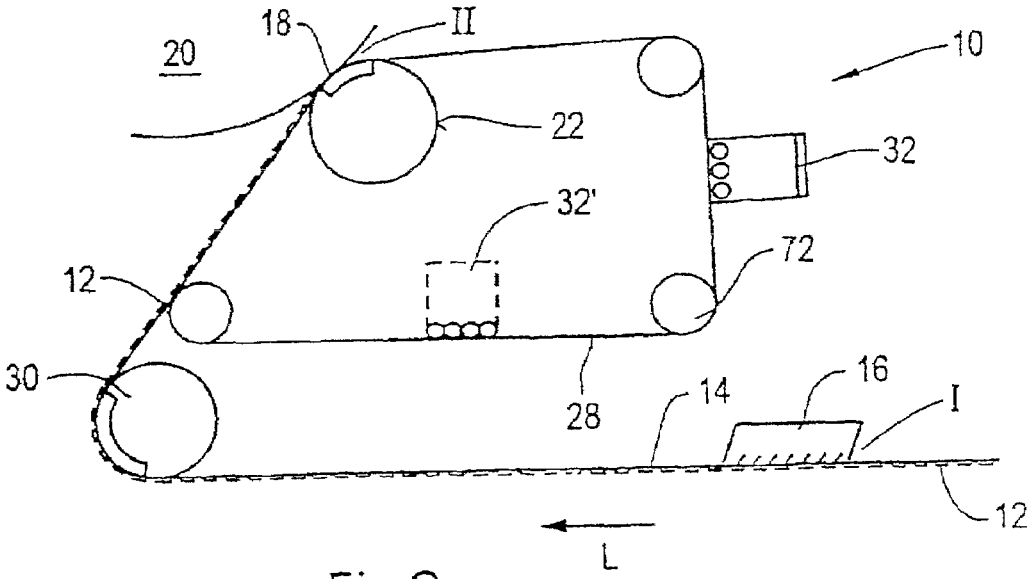
FIG. 2 is a schematic partial representation of a modified embodiment of the apparatus in which the felt is guided over the device not subject to suction.

Now, additionally referring to FIG. 2, there is shown an embodiment that differs from that in FIG. 1, in that felt 28 is only joined with shown in imprinting fabric 14 that supports fiber web 12 after the device subject to suction 30. The device subject to suction 30 is therefore not wrapped around by felt 28, whereby its suction effect is increased and the dry content of fiber web 12 is increased correspondingly. The wet molding effect is maintained by the relatively gentle dewatering of the TissueFlex process in which the pressure is lower in contrast to a conventional shoe press.

As in the embodiment shown in FIG. 1, suction device 32 is arranged in front of the lower deflection roll 72 (representation in solid lines). However, an arrangement is also possible for positioning suction device 32' (broken line representation) after lower deflection roll 72.

Figure 3:
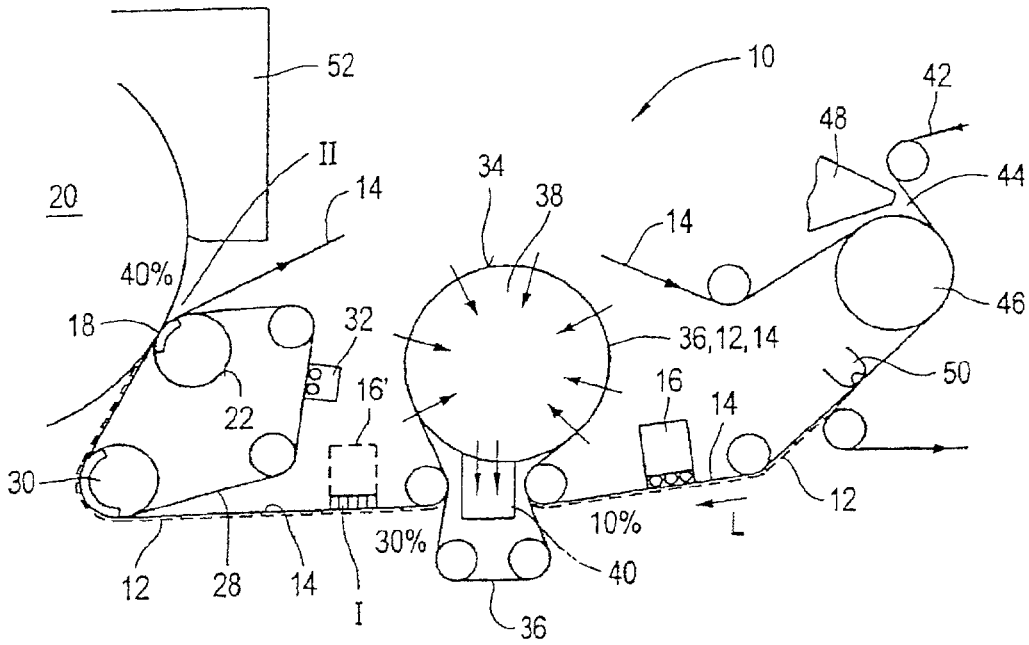
FIG. 3 is a schematic partial representation of another embodiment of an apparatus for the manufacture of a fiber web provided with a three-dimensional surface structure with a dewatering apparatus additionally provided in which the capillary effect of a clothing with fine pores is utilized for the dewatering.

Now, additionally referring to FIG. 3, there is shown an embodiment of the present invention in which a dewatering apparatus 34 is added. Dewatering apparatus 34 includes a clothing 36 with fine pores having a capillary effect, which can be a felt or a screen with a foamed coating. A respective foam coating is selected such that pores result in a range of from approximately 3 μm up to approximately 6 μm.

Clothing 36 with fine pores is guided together with imprinting fabric 14 and fiber web 12 lying therebetween about suction roll 38, with clothing 36 being in contact with suction roll 38. The suction roll 38, which is wrapped around by clothing 36, can have a diameter of approximately 2 m up to approximately 3 m. The lower side of suction roll 38 is acted on by a vacuum. Siphon extraction can generally also be associated with suction roll 38. The respective vacuum device is designated by "40" in FIG. 3.

At least one dewatering screen with zonally different screen permeability is provided in the forming zone.

A former with two peripheral dewatering fabrics 14 and 42 is provided, with internal fabric 14 simultaneously serving as the imprinting fabric 14. Dewatering fabrics 14 and 42 run together thereby forming a material inlet gap 44 and are guided over forming element 46 such as forming roll 46.

Imprinting fabric 14 is formed as the internal fabric of the former coming into contact with forming element 46. External fabric 42 that does not come into contact with forming element 46, serves as a dewatering screen with a zonally different screen permeability.

A pulp suspension is introduced into material inlet gap 44 by way of a head box 48. A pick-up element 50 also known as partition element 50 is positioned after forming element 46 and web 12 is thereby held to imprinting fabric 14 upon the separation of dewatering fabric 42. Suction element 16 (solid-line representation) is provided in front of device 34 with a capillary effect and fiber web 12 is pressed onto imprinting fabric 14 by it. Suction element 16 can, however, also be arranged s shown by suction element 16', between device 34 and suction roll 30.

A soft fabric 28 or a clothing 28 with fine pores and having a capillary effect such as felt 28, is guided, together with fiber web 12 and imprinting fabric 14, through press nip 18 formed between drying cylinder 20 and shoe press unit 22. Soft fabric 28 is also guided about suction device 30. As already mentioned, this soft fabric 28 can, for example, be a clothing 28 with fine pores having a capillary effect, such as felt 28 having a corresponding capillary effect, also known as capillary felt 28. Felt 28 is conditioned via a suction device 28 or a so-called UHLE box. Drying cylinder 20 is a Yankee cylinder 32. Drying hood 52 can be associated with drying cylinder 20.

The dry content of fiber web 12 in front of dewatering unit 34 amounts to approximately 10% up to approximately 25%. In the region following device 34 the dry content is approximately 30% to approximately 40%.

Figure 4:
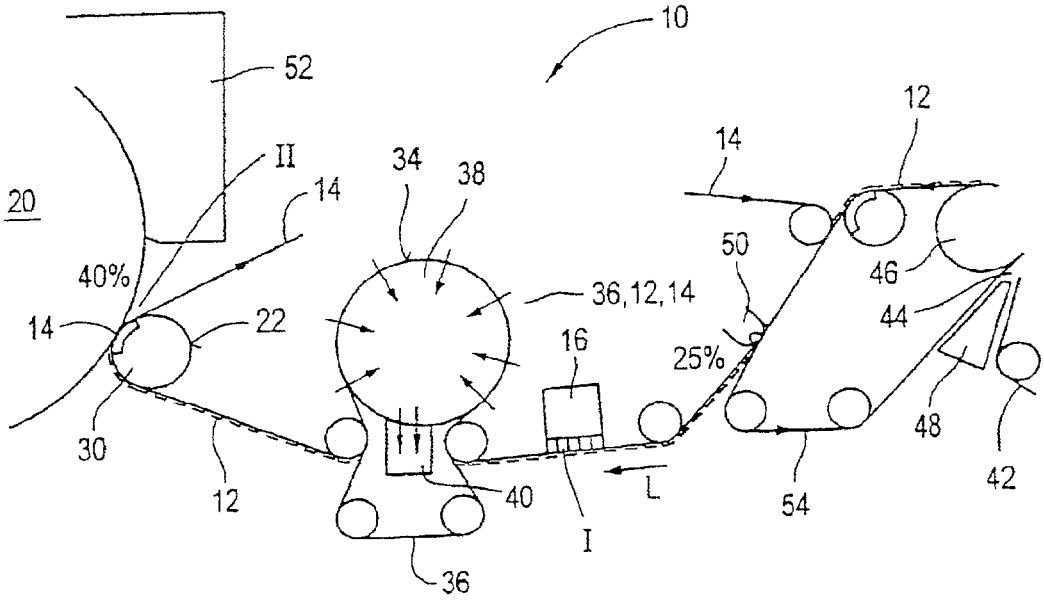
FIG. 4 is a schematic partial representation of a further embodiment of an apparatus for the manufacture of a fiber web provided with a three-dimensional surface structure with a dewatering apparatus additionally provided in which the capillary effect of a clothing with fine pores, is utilized for the dewatering.

Now, additionally referring to FIG. 4, there is shown another embodiment of the present invention that differs from FIG. 3 in that fiber web 12 is transferred from internal fabric 54 of the former to imprinting fabric 14. Internal fabric 54 or external fabric 42 of the former can, be a dewatering screen with zonally different screen permeability. Peripheral dewatering fabrics 42 and 54 run together thereby forming material inlet gap 44, and they are guided over forming element 46 such as forming roll 46. Material inlet gap 44 is loaded with stock suspension by way of head box 48. Unlike the embodiment illustrated in FIG. 3, the stock suspension is, supplied from below.

A pick-up 50 or partition element 50 is within the loop of imprinting fabric 14 and fiber web 12 is held to imprinting fabric 14 upon the separation or internal fabric 54 of the former.

Suction element 16 is within the loop of imprinting fabric 14 and is arranged in front of dewatering device 34 with a capillary effect. However, suction element 16 may be arranged after device 34. Additionally, felt 28 is not utilized in this embodiment.

The dry content of fiber web in the present embodiment amounts to approximately 10% up to approximately 25% in the region of pick-up element 50, to approximately 15% up to approximately 30% in the region of dewatering device 34 and to approximately 35% up to approximately 45% in the region after device 34.

Figure 5:
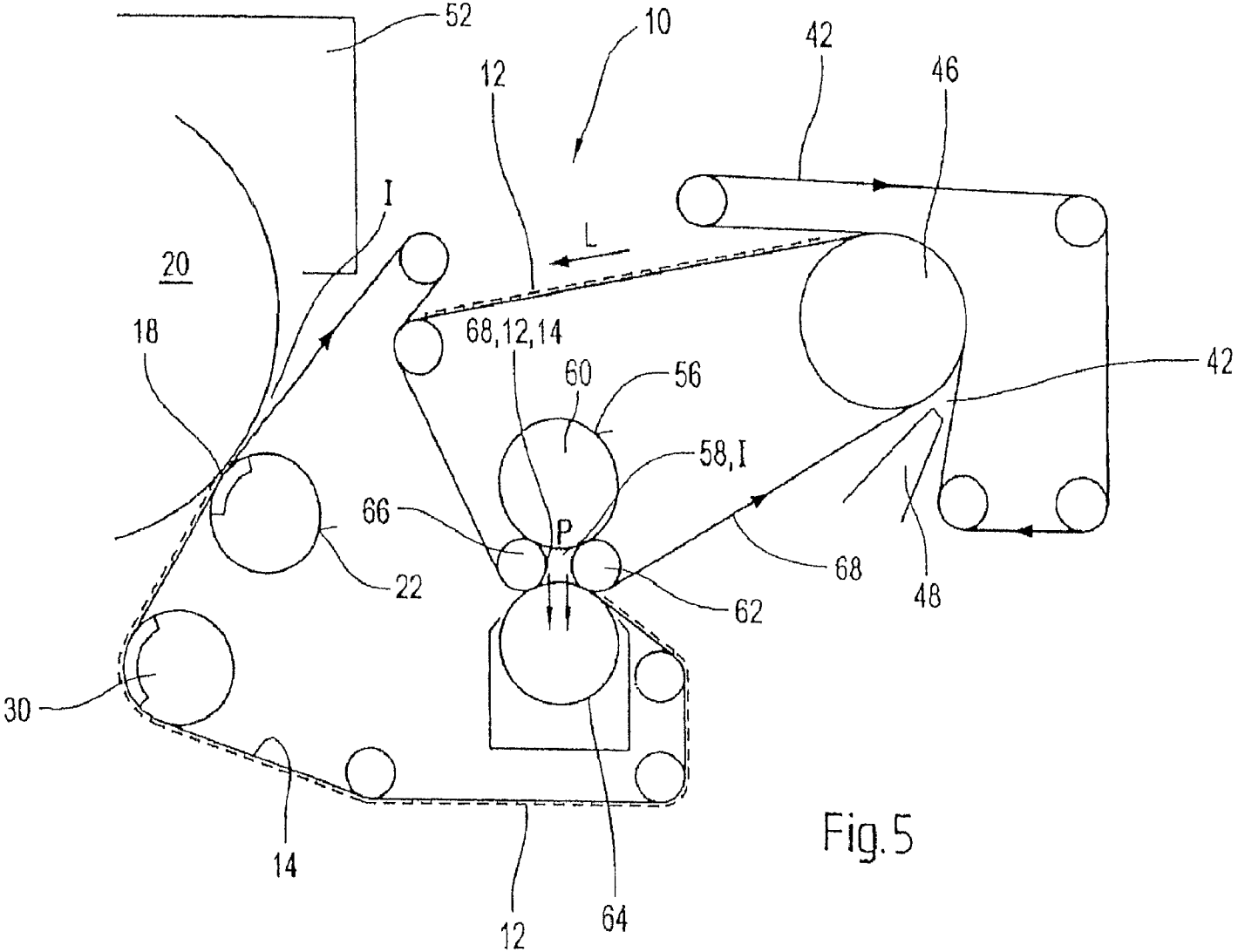
FIG. 5 is a schematic partial representation of another embodiment of an apparatus for the manufacture of a fiber web provided with a three-dimensional surface structure in which a displacement press is additionally provided.

Now, additionally referring to FIG. 5 there is shown an embodiment of apparatus 10 in which a displacement press 56 is provided. Fiber web 12 is guided at least once, together with imprinting fabric 14 by way of gas pressure for the expulsion of water, through pressure space 58, which is bounded by at least four rolls 60, 62, 64 and 66 arranged in parallel and into which a pressure gas is introduced. Fiber web 12 is guided through pressure space 58 together with imprinting fabric 14 and membrane 68. Membrane 68 forms the internal fabric of the former, which in turn includes a forming element 46 such as a forming roll 46, in whose region internal fabric 68 and external fabric 42 run together while forming a material inlet gap 44, which is loaded with stock suspension by way of a head box 48.

After passing air press 56, fiber web 12 is guided, together with imprinting fabric 14, over device subject to suction 30, in particular over a suction roll 30, and through press nip 18 formed between drying cylinder 20 and shoe press unit 22. Drying hood 52 is associated with drying cylinder 20 also known as Yankee cylinder 20.

First pressure field I, by which fiber web 12 is pressed onto imprinting fabric 14, at a dry content of <50% and is correspondingly pre-imprinted, is produced, by air press 56.

Figure 6:
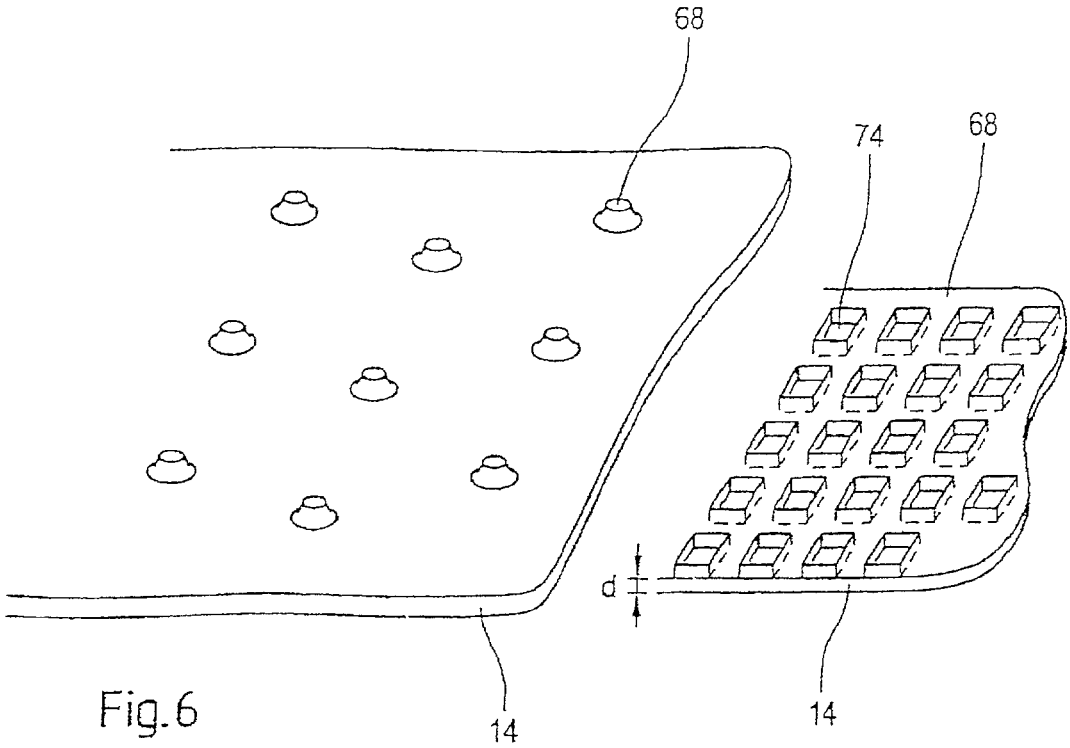
FIG. 6 is a schematic partial representation of an imprinting fabric used in the apparatus of FIGS. 1-5 with a smaller surface portion of raised zones in comparison with the surface portion of recessed zones.
Figure 7:
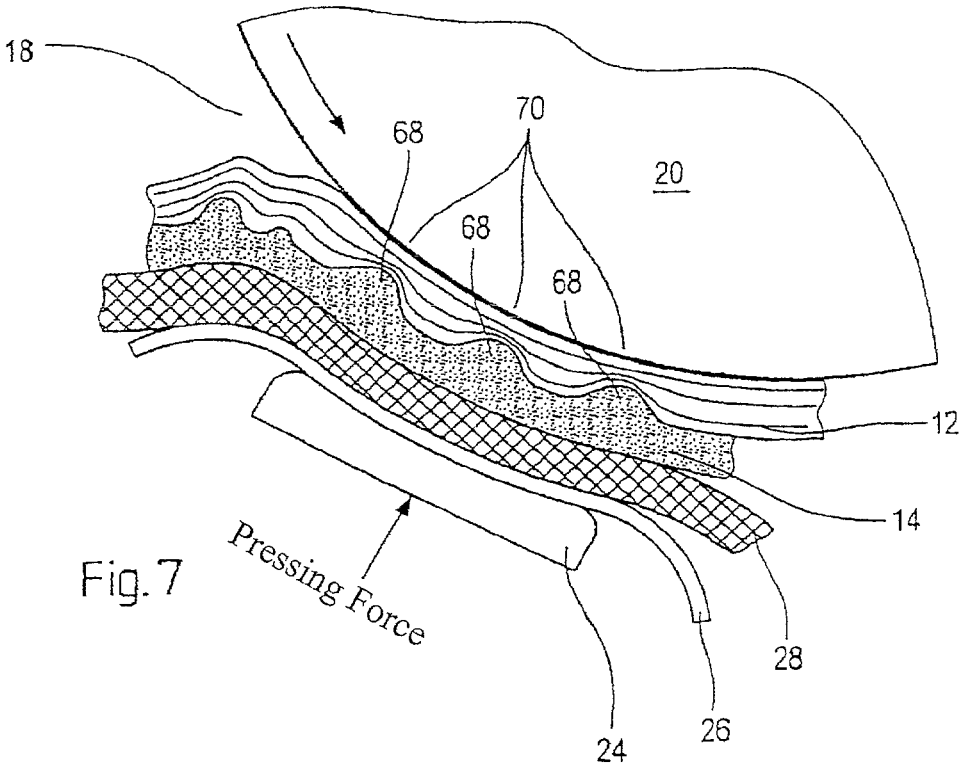
FIG. 7 is a schematic section of a press nip through which the imprinting fabric shown in FIG. 6 is guided together with the fiber web and with a felt.

Now, additionally referring to FIGS. 6 and 7, there is shown imprinting fabric 14, in the form of an imprinting screen 14, as illustrated in the left hand part of FIG. 6 or an imprinting membrane 14 as illustrated in the right hand side of FIG. 6, guided by press nip 18 is structured such that a smaller surface portion of raised or closed zones 68 results for imprinting fabric 14 in comparison with the surface portion of recessed zone or bores 74 and a smaller surface portion of fiber web 12 is accordingly pressed in press nip 18. The surface portion of raised or closed zones 68 is ≦40% and can preferably lie in a range from approximately 25% to approximately 30%.

Raised zones 68 and the recessed zones can result, for example, by offsets, at intersection points of weft and warp threads of a screen fabric. In the case of the press membrane illustrated in the right hand part of FIG. 6, a corresponding structure results by bores 74.

FIG. 6 shows a schematic partial representation of a corresponding imprinting fabric 14, embodied as an imprinting felt 14 or imprinting membrane 14, with a smaller surface portion of raised or closed zones 68 in comparison with the surface portion of recessed zones or bores 74.

A thickness d of imprinting membrane 14 is shown in the right hand part of FIG. 6 and can amount to approximately 1 mm up to approximately 3 mm. The open surface can in particular be larger than 50% and preferably larger than 60% and more preferably lie in a region from approximately 70% up to approximately 75%. Membrane 14 consists of a material resistant to the fiber chemistry and can, for example, consist of polyester.

FIG. 7 shows a schematic section through press nip 18 with imprinting fabric 14 guided together with fiber web 12 and felt 28. Soft fabric 28 is in contact with flexible fabric 26 of shoe press unit which is guided in the region of press nip 18 over press shoe 24 by which a desired pressing force can be applied. Fiber web 12 contacts drying cylinder 20, preferably a Yankee cylinder. Pressing zones 70 result as a consequence of raised zones 68 of fabric 14. Fiber web 12 is already imprinted in front of nip 18, as can be recognized with reference to FIG. 7, wherein it already contacts imprinting fabric 14 before entering the nip 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE NUMERAL LIST

10 apparatus
12 fiber web
14 imprinting fabric
16 suction element
18 press nip
20 drying cylinder, Yankee cylinder
20' surface
22 counter element, shoe press unit
24 press shoe
26 flexible fabric, flexible roll jacket
28 soft fabric or clothing with fine pores and with a capillary effect, soft felt
30 device subject to suction, suction roll
32 suction device, suction roll
34 dewatering device with capillary effect
36 clothing with fine pores with capillary effect, felt with foamed layer
38 large suction roll
40 vacuum, siphon extraction
42 dewatering fabric
44 material inlet gap
46 forming element, forming roll
48 head box
50 pick-up or partition element
52 drying hood
54 internal dewatering screen
56 air press
58 pressure space
60 roll
62 roll
64 roll
66 roll
68 raised zones
70 pressing zones
72 deflection roll
74 bores
d thickness
L web running direction
I first pressure field
II further pressure field

What is claimed is:

1. A method for the manufacture of a structured fiber web, comprising the steps of:

pressing a fiber web onto an imprinting fabric by way of a first pressure field, thereby pre-imprinting said fiber web, said fiber web having a dry content of less than approximately 35%;

subsequently pressing said fiber web onto said imprinting fabric by way of a further pressure field for further dewatering and drying to thereby fix a three-dimensional surface structure and strength of the fiber web;

delivering the fiber web to a drying cylinder by said imprinting fabric; and exposing the fiber web to air moved by at least three throughflow apparatuses, each of said at least three throughflow apparatuses having a corresponding throughflow direction, at least one of said throughflow directions being different than an other throughflow direction, said first pressure field being a suction element that is arranged along the side of the imprinting fabric with the fiber web on an opposite side of the imprinting fabric.

2. The method of claim 1, wherein said imprinting fabric is an imprinting screen.

3. The method of claim 1, wherein said imprinting fabric is an imprinting membrane.

4. The method of claim 1, wherein said pre-imprinting occurs downstream from a forming zone in a machine direction.

5. The method of claim 1, further comprising the step of forming said fiber web on said imprinting fabric.

6. The method of claim 1, further comprising the step of transferring said fiber web onto said imprinting fabric.

7. The method of claim 1, further comprising the step of fixing a surface structure of said fiber web on said imprinting fabric.

8. The method of claim 1, wherein each of said at least three throughflow apparatuses include a suction device.

9. The method of claim 1, wherein at least one of said at least three throughflow apparatuses includes a suction device and at least one of said at least three throughflow apparatuses includes an air press.

10. The method of claim 1, wherein said at least three throughflow apparatuses includes a first throughflow apparatus, a second throughflow apparatus and a third throughflow apparatus, said first throughflow apparatus, said second throughflow apparatus and said third throughflow apparatus arranged sequentially in a direction in which said fiber web runs, said first throughflow apparatus including a suction device, said second throughflow apparatus including an air press and said third throughflow apparatus including an other suction device.

11. The method of claim 1, wherein at least one of said at least three throughflow apparatuses includes at least one suction device, said at least one suction device including one of a suction roll and a suction box.

12. The method of claim 11, wherein said at least one suction device supplies a pressure differential of from approximately 0.2 bar to approximately 0.4 bar.

13. The method of claim 11, wherein said at least one suction device is positioned proximate to a region having a temperature of one of less than and equal to approximately 220° C.

14. The method of claim 13, wherein said temperature is less than approximately 180° C.

15. The method of claim 14, wherein said temperature is less than approximately 150° C.

16. The method of claim 11, wherein said at least one suction device imparts an airflow speed through said fiber web of one of less than and equal to approximately 15 m/s.

17. The method of claim 16, wherein said airflow speed is one of less than and equal to approximately 8 m/s.

18. The method of claim 11, wherein said at least one suction device defines a suction zone proximate to a portion of said fiber web, said fiber web having a dwell time in said suction zone of one of less than and equal to approximately 0.5 seconds.

19. The method of claim 18, wherein said dwell time is one of less than and equal to approximately 0.4 seconds.

20. The method of claim 19, wherein said dwell time is one of less than and equal to approximately 0.3 seconds.

21. The method of claim 1, wherein said first pressure field is produced by a suction element arranged on a side of said imprinting fabric, said fabric web on an opposite side of said imprinting fabric.

22. The method of claim 21, wherein said suction element is a wet suction box.

23. The method of claim 1, wherein said pressing step occurs over a path extended in a web running direction.

24. The method of claim 1, wherein said further pressure field is produced by way of a press nip.

25. The method of claim 24, wherein said press nip is formed between a drying cylinder and a counter-element, said fiber web being guided through said press nip is in contact with said drying cylinder and said imprinting fabric.

26. The method of claim 25, wherein said drying cylinder is a Yankee cylinder.

27. The method of claim 25, wherein said counter-element is a shoe press unit having a press shoe and a flexible fabric guided over said press shoe proximate to said press nip.

28. The method of claim 27, wherein said shoe press unit includes a press roll with a flexible roll jacket.

29. The method of claim 25, wherein said pre-imprinted fiber web is dried on said drying cylinder and said pre-imprinted fiber web is at least one of creped and wound up.

30. The method of claim 24, wherein said imprinting fabric forms a loop, one of a soft fabric, a clothing with fine pores and a capillary effect, and felt is inside said loop and travels through said press nip.

31. The method of claim 24, wherein said dry content of said fiber web when said fiber web is one of pre-imprinted and has a three-dimensional surface structure fixed is less than approximately 35%.

32. The method of claim 31, wherein said dry content is less than approximately 30%.

33. The method of claim 32, wherein said dry content is less than approximately 25%.

34. The method of claim 24, further comprising the step of positioning a device subject to suction between said first pressure field and said press nip, said imprinting fabric guiding said fabric web over said device subject to suction and through said press nip.

35. The method of claim 34, wherein said device subject to suction has a curved surface, said fiber web and said imprinting fabric being guided over said curved surface.

36. The method of claim 35, wherein said device subject to suction is a suction roll.

37. The method of claim 24, further comprising the step of guiding a felt that is positioned between said imprinting fabric and a flexible fabric of a shoe press unit through said press nip.

38. The method of claim 37, wherein said felt is additionally guided over a device subject to suction.

39. The method of claim 38, wherein said device subject to suction is associated with a hood under overpressure, thereby supporting an underpressure condition of said device subject to suction.

40. The method of claim 38, further comprising the step of conditioning said felt with a suction device prior to where said felt joins with said imprinting fabric to support said fiber web.

41. The method of claim 38, further comprising the step of joining said felt with said imprinting fabric after said device subject to suction.

42. The method of claim 24, further comprising the step of applying a pressure profile to said fiber web by way of a shoe press at said press nip, said press nip having a length in a web running direction of at least approximately 80 mm, said pressure profile having a maximum pressing pressure of one of less than and equal to approximately 2.5 MPa.

43. The method of claim 24, further comprising the step of guiding said imprinting fabric through said press nip, said imprinting fabric being one of an imprinting screen and an imprinting membrane, said imprinting fabric having at least two surface portions including a first surface portion and a second surface portion, said first surface portion including at least one of raised and closed zones, said second surface portion including at least one of recessed zones and bores, said first surface portion smaller than said second surface portion.

44. The method of claim 43, wherein said first surface portion is one of less than and equal to approximately 40% of said imprinting fabric.

45. The method of claim 44, wherein said first surface portion is in the range of approximately 25% to approximately 30%.

46. The method of claim 43, wherein said first surface portion includes raised zones, said second surface portion includes recessed zones, said raised zones and said recessed zones resulting from intersection points of weft threads and warp threads of said imprinting fabric.

47. The method of claim 1, further comprising the step of forming said fiber web in a forming zone, said fiber web proximate to at least one dewatering screen, at least one of said at least one dewatering screens having zonally different screen permeability in said forming zone.

48. The method of claim 47, further comprising forming a material inlet gap by two dewatering fabrics that are guided over a forming element, said at least one dewatering screen at least one of serving as an external fabric not coming into contact with said forming element and serving as an internal fabric.

49. The method of claim 47, wherein said imprinting fabric is an internal fabric and said dewatering screen is an external fabric.

50. The method of claim 49, further comprising the step of transferring said fiber web from said internal fabric to said imprinting fabric.

51. The method of claim 1, further comprising the step of dewatering said fiber web using a clothing with fine pores having a capillary effect.

52. The method of claim 51, wherein said clothing includes a foamed layer connected to at least one of a felt and a screen.

53. The method of claim 52, wherein said foamed layer includes pores having openings in the range of from approximately 3 μm to approximately 6 μm.

54. The method of claim 53, wherein said clothing is in at least partial contact with a suction roll, said suction roll having a diameter of from approximately 2 m to approximately 3 m.

55. The method of claim 54, further comprising the step of directing a vacuum to a lower side of said suction roll.

56. The method of claim 53, wherein said clothing is in at least partial contact with a plurality of suction rolls, said plurality of suction rolls having a diameter of approximately 2 m.

57. The method of claim 52, further comprising the step of contacting a side of said fiber web with said clothing while an other side of said fiber web is in contact with said imprinting fabric, said clothing in contact with a suction roll.

58. The method of claim 1, further comprising the step of removing water from said fiber web by one of using a suction roll with an associated siphon extraction and centrifuging said water into a gutter by centrifugal force.

59. A method of claim 1, further comprising the step of guiding said fiber web together with said imprinting fabric at least once through a pressure space, said pressure space being bounded by at least four rolls arranged in parallel and having a pressurized gas introduced therein.

60. The method of claim 59, wherein said fiber web and said imprinting fabric travel through said pressure space twice.

61. The method of claim 59, wherein said guiding step additionally includes a membrane being guided with said imprinting fabric and said fabric web.

62. The method of claim 1, wherein said imprinting fiber is an imprinting membrane having a thickness of approximately 1 mm to approximately 3 mm.

63. The method of claim 62, wherein said imprinting membrane has on open surface of at least 50%.

64. The method of claim 63, wherein said open area is at least 60%.

65. The method of claim 64, wherein said open area is in a range of approximately 70% to approximately 75%.

66. The method of claim 1, further comprising the step of vacuum dewatering said fiber web using a pressure differential of one of equal to and greater than 0.1 bar.

67. The method of claim 66, wherein said pressure differential is one of equal to and greater than 0.2 bar.

68. The method of claim 67, wherein said pressure differential is one of equal to and greater than 0.3 bar.

69. The method of claim 66, wherein said pressure differential is in the range of approximately 0.2 bar to approximately 0.4 bar.

70. The method of claim 66, wherein said vacuum dewatering step utilizes a clothing with fine pores, said clothing being one of a screen or a felt, said clothing having a foamed layer.

71. The method of claim 66, wherein said vacuum dewatering step occurs with an airflow volume of one of less than and equal to 50 $m^3/(m^2*minute)$.

72. The method of claim 71, wherein said airflow volume is one of less than and equal to 20 $m^3/(m^2*minute)$.

73. The method of claim 72, wherein said airflow volume is one of less than and equal to 5 $m^3/(m^2*minute)$.

74. The method of claim 73, wherein said airflow volume is one of less than and equal to 1 $m^3/(m^2*minute)$.

* * * * *